US009156081B2

(12) United States Patent
Kurosawa et al.

(10) Patent No.: US 9,156,081 B2
(45) Date of Patent: Oct. 13, 2015

(54) MOLD FOR CONTINUOUS CASTING OF TITANIUM OR TITANIUM ALLOY INGOT, AND CONTINUOUS CASTING DEVICE PROVIDED WITH SAME

(71) Applicant: Kobe Steel, Ltd., Hyogo (JP)

(72) Inventors: Eisuke Kurosawa, Kobe (JP); Takehiro Nakaoka, Kobe (JP); Kazuyuki Tsutsumi, Kobe (JP); Hideto Oyama, Takasago (JP); Hidetaka Kanahashi, Takasago (JP); Hitoshi Ishida, Kobe (JP); Daiki Takahashi, Kobe (JP); Daisuke Matsuwaka, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 14/376,301

(22) PCT Filed: Apr. 2, 2013

(86) PCT No.: PCT/JP2013/060116

§ 371 (c)(1),
(2) Date: Aug. 1, 2014

(87) PCT Pub. No.: WO2013/151061

PCT Pub. Date: Oct. 10, 2013

(65) Prior Publication Data

US 2015/0047801 A1 Feb. 19, 2015

(30) Foreign Application Priority Data

Apr. 2, 2012 (JP) ..... 2012-083683

(51) Int. Cl.

| | |
|---|---|
| ***B22D 11/055*** | (2006.01) |
| ***B22D 11/00*** | (2006.01) |
| ***B22D 11/041*** | (2006.01) |

(52) U.S. Cl.
CPC ..... *B22D 11/001* (2013.01); *B22D 11/041* (2013.01); *B22D 11/055* (2013.01)

(58) Field of Classification Search
CPC ..... B22D 11/001; B22D 11/055
USPC ..... 164/418–444, 485
See application file for complete search history.

(56) References Cited

U.S. PATENT DOCUMENTS 3,336,973 A * 8/1967 Ratcliffe ..... 164/435
3,685,571 A * 8/1972 Niskovskikh et al. ..... 164/443

(Continued)

FOREIGN PATENT DOCUMENTS

JP H07-116783 A 5/1995
JP H07-118773 A 5/1995
JP H10-286652 A 10/1998

OTHER PUBLICATIONS

International Search Report; PCT/JP2013/060116; Jul. 16, 2013.

(Continued)

*Primary Examiner* — Kevin E Yoon
(74) *Attorney, Agent, or Firm* — Studebaker & Brackett PC

(57) ABSTRACT

A mold (2) has a cooling means (21) for having the thermal flux at four corner sections (2*a*) be smaller than the thermal flux at four face sections (2*b*). The cooling means (21) has first channels (22*a*) which are each embedded in the four corner sections (2*a*) respectively and which channel cooling water, and second channels (22*b*) which are each embedded in the four face sections (2*b*) respectively and which channel cooling water. The distance from the inner peripheral surface of the mold (2) to the first channels (22*a*) is greater than the distance from the inner peripheral surface of the mold (2) to the second channels (22*b*).

11 Claims, 13 Drawing Sheets

(56) References Cited

U.S. PATENT DOCUMENTS

| | | | | |
|---|---|---|---|---|
| 5,379,828 | A * | 1/1995 | Blazek et al. | 164/459 |
| 2001/0042609 | A1 * | 11/2001 | Poloni et al. | 164/485 |

OTHER PUBLICATIONS

Written Opinion of the International Searching Authority; PCT/JP2013/060116; Jul. 16, 2013.

* cited by examiner (a)

(b)

MOLD FOR CONTINUOUS CASTING OF TITANIUM OR TITANIUM ALLOY INGOT, AND CONTINUOUS CASTING DEVICE PROVIDED WITH SAME

TECHNICAL FIELD

The present invention relates to: a continuous casting device continuously casting an ingot of titanium or titanium alloy; and a mold used for the device.

BACKGROUND ART

An ingot is cast continuously by pouring metal melted by vacuum arc melting or electron beam melting into a mold not having a bottom section and extracting the metal downward while the metal is solidified.

Further, Patent Literature 1 discloses a method for producing a titanium or titanium alloy rolled material. In the method, a thin-walled slab is produced by continuously casting titanium or titanium alloy melted by plasma in an inert gas atmosphere uninterruptedly in the inert gas atmosphere and a strip is produced by rolling the slab. A titanium or titanium alloy rolled material is obtained by rolling the strip.

CITATION LIST

Patent Literature

Patent Literature 1: Japanese Unexamined Patent Publication No. H7-118773

SUMMARY OF INVENTION

Technical Problem

Meanwhile, if unevenness or a flaw exists on the surface of a cast ingot (ingot skin) when a titanium or titanium alloy ingot is cast continuously, the unevenness or the flaw causes a surface defect during a subsequent rolling process. Consequently, unevenness or a flaw on an ingot surface has to be removed by cutting or the like before rolling. This causes a lower yield, an increase of working processes, and thus a cost increase. For the reason, the casting of an ingot having no unevenness or flaw on the surface is desired.

Here, it is estimated that a surface defect of an ingot is caused because a solidified shell grows excessively in the vicinity of the wall surface of a mold and is exposed on a molten metal surface and molten metal covering appears. It is also estimated that a surface defect of an ingot is caused because a solidified shell breaks by a frictional force acting on the interface between a grown solidified shell and a mold when the ingot is extracted from the mold. It is also estimated that a surface defect of an ingot is caused because molten metal flows into a gap formed between a solidified and shrunk solidified shell and a mold and solidifies.

In order to inhibit a solidified shell from growing in the vicinity of the wall surface of a mold, it is necessary to increase the output of a heating device, increase a heat input to a molten metal surface, and remelt the solidified shell. In the vicinity of a molten metal surface, however, heat extracted from a mold is large and titanium has low thermal conductivity. As a result, an initial solidified shell may not sufficiently be melted. Here, in the case of plasma arc melting, heat can hardly be applied to a corner section where two sides of a mold having a rectangular sectional shape touch each other in comparison with the case of electron beam melting. This is one of the reasons why a solidified shell in the vicinity of a wall surface cannot be remelted.

In view of the above situation, it is considered to cool an interface between a mold and molten metal slowly and melt an initial solidified shell by reducing a contact heat-transfer coefficient between the mold and the molten metal and reducing heat extracted from the molten metal.

In a mold having a rectangular sectional shape, however, molten metal at a corner section where two sides touch each other is likely to be cooled more than molten metal at a face section. A resultant problem is that the growth rate of a solidified shell is higher at a corner section than at a face section and a surface defect is likely to be caused at the corner section. Here, a face section means a section of a mold interposed between two corner sections.

An object of the present invention is to provide titanium or a device for titanium capable of casting an ingot having fewer defects on the surface.

Solution to Problem

A mold for continuous casting of a titanium or titanium alloy ingot according to the present invention is a mold being used for continuously casting the titanium or titanium alloy ingot and being rectangular in cross-section but not having a bottom section, into which molten metal of titanium or titanium alloy is poured, wherein the mold has a cooling means for making a thermal flux at four corner sections of the mold smaller than a thermal flux at four face sections interposed between the corner sections.

In the configuration, since a thermal flux at four corner sections of a mold is smaller than a thermal flux at four face sections of the mold, it is possible to equalize the cooling rate of molten metal at the corner sections and the cooling rate of the molten metal at the face sections. As a result, it is possible: to equalize the shape of a solidified shell in the mold; and hence to inhibit the generation of molten metal covering, the breakage of the solidified shell, molten metal intrusion caused by solidification and shrinkage of the solidified shell, and others. Consequently, it is possible to cast an ingot having fewer defects on the surface. Here, a thermal flux represents a heat quantity per unit area and unit time.

Further, in a mold for continuous casting of a titanium or titanium alloy ingot according to the present invention, a cooling means may have flow channels embedded at four face sections of the mold respectively, through which a cooling fluid flows. In the configuration, molten metal touching the face sections is cooled by a cooling fluid flowing through the flow channels embedded at the four face sections of the mold respectively. In contrast, since no flow channels are installed at four corner sections of the mold, a thermal flux at the four corner sections of the mold is smaller than a thermal flux at the four face sections of the mold. As a result, it is possible to equalize the cooling rate of the molten metal at the corner sections and the cooling rate of the molten metal at the face sections.

Further, in a mold for continuous casting of a titanium or titanium alloy ingot according to the present invention, a cooling means may have slow-cooling layers being embedded at four corner sections of the mold respectively and having smaller thermal conductivity than the mold. In the configuration, a thermal flux at the four corner sections of the mold is smaller than a thermal flux at four face sections of the mold by the slow-cooling layers embedded at the four corner sections of the mold respectively. As a result, it is possible to equalize the cooling rate of molten metal at the corner sections and the cooling rate of the molten metal at the face sections.

Further, in a mold for continuous casting of a titanium or titanium alloy ingot according to the present invention: a cooling means may have first flow channels embedded at four corner sections of the mold respectively, through which a cooling fluid flows, and second flow channels embedded at four face sections of the mold respectively, through which the cooling fluid flows; and a distance from the inner peripheral surface of the mold to the first flow channels may be larger than a distance from the inner peripheral surface of the mold to the second flow channels. In the configuration, molten metal touching the corner sections is cooled by the cooling fluid flowing through the first flow channels embedded at the four corner sections of the mold respectively. Further, molten metal touching the face sections is cooled by the cooling fluid flowing through the second flow channels embedded at the four face sections of the mold respectively. Meanwhile, since the distance from the inner peripheral surface of the mold to the first flow channels is larger than the distance from the inner peripheral surface of the mold to the second flow channels, a thermal flux at the four corner sections of the mold is smaller than a thermal flux at the four face sections of the mold. As a result, it is possible to equalize the cooling rate of the molten metal at the corner sections and the cooling rate of the molten metal at the face sections.

Further, in a mold for continuous casting of a titanium or titanium alloy ingot according to the present invention: first flow channels and second flow channels may be installed extendedly in a horizontal direction; and a cooling means may further have bypass flow channels connecting the first flow channels to the second flow channels. In the configuration, since the first flow channels and the second flow channels installed extendedly in the horizontal direction are connected through the bypass flow channels, it is possible to feed a cooling fluid from the first flow channels to the second flow channels. Consequently, it is possible to: reduce the number of the inlets and outlets of the flow channels; and allow the cooling fluid to flow easily.

Further, in a mold for continuous casting of a titanium or titanium alloy ingot according to the present invention, a cooling means may further have slow-cooling layers being embedded at four corner sections of the mold on a side closer to the inner peripheral surface of the mold than first flow channels respectively and having smaller thermal conductivity than the mold. In the configuration, a thermal flux at the four corner sections of the mold is smaller than a thermal flux at four face sections of the mold by the slow-cooling layers embedded at the four corner sections of the mold respectively. As a result, it is possible to equalize the cooling rate of molten metal at the corner sections and the cooling rate of the molten metal at the face sections.

Further, a continuous casting device for a titanium or titanium alloy ingot according to the present invention is characterized by having: a mold stated above; a molten metal pouring device to pour molten metal into the mold; and an extractor to extract an ingot formed by solidifying the molten metal in the mold below the mold.

In the configuration, since a thermal flux at four corner sections of the mold is smaller than a thermal flux at four face sections of the mold, it is possible to equalize the cooling rate of the molten metal at the corner sections and the cooling rate of the molten metal at the face sections. As a result, it is possible to: equalize the shape of a solidified shell in the mold; and cast an ingot having fewer defects on the surface.

Advantageous Effects of Invention

By a mold for continuous casting of a titanium or titanium alloy ingot and a continuous casting device having the mold according to the present invention, a thermal flux at four corner sections of the mold is made smaller than a thermal flux at four face sections of the mold. As a result, it is possible to: equalize the cooling rate of molten metal at the corner sections and the cooling rate of the molten metal at the face sections; hence equalize the shape of a solidified shell in the mold; and cast an ingot having fewer defects on the surface.

DESCRIPTION OF EMBODIMENTS

Preferable embodiments according to the present invention are explained hereunder in reference to drawings.

First Embodiment

Configuration of Continuous Casting Device

Figure 1:
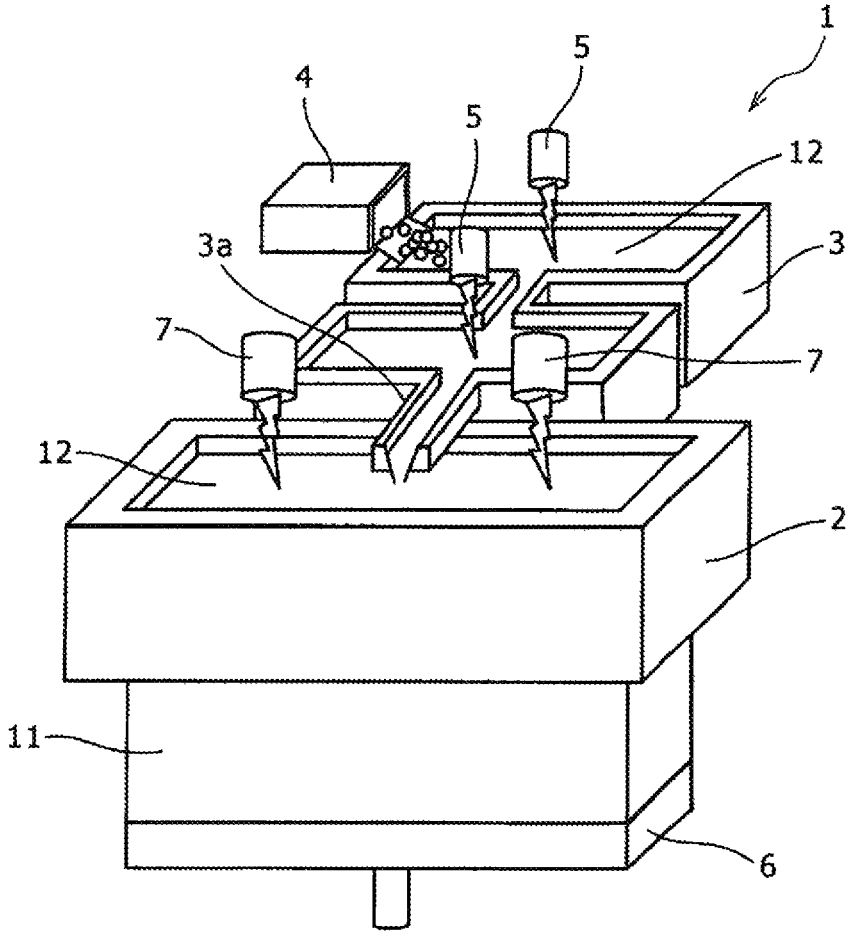
FIG. 1 is a perspective view showing a continuous casting device according to the first embodiment.
Figure 2:
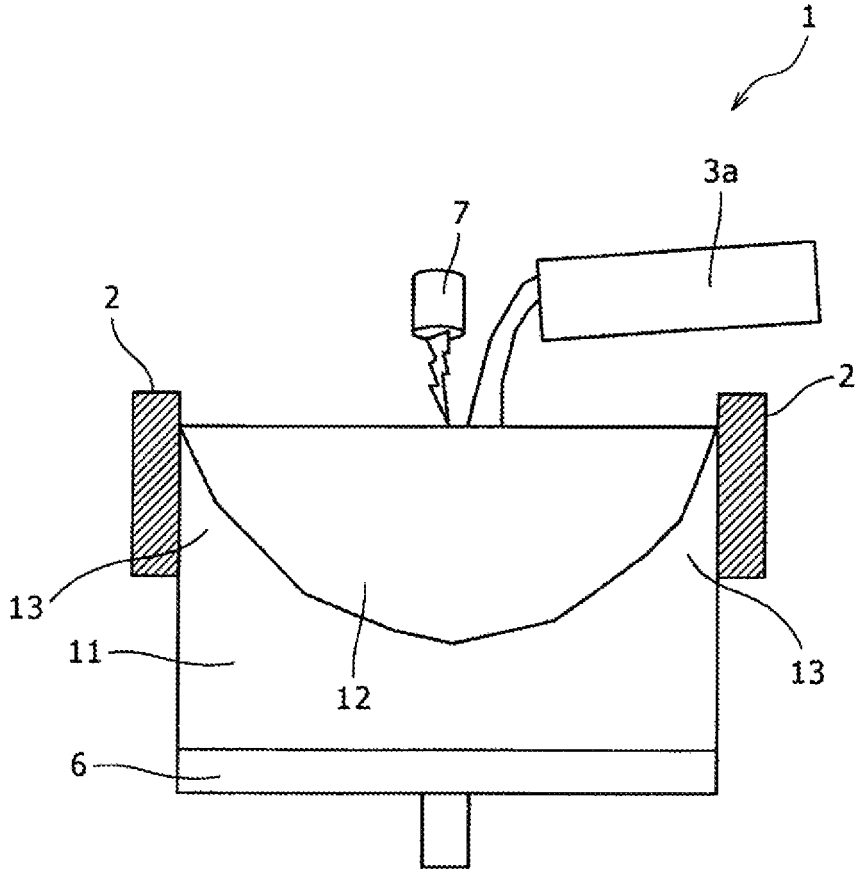
FIG. 2 is a sectional view showing the continuous casting device in FIG. 1.

A mold (mold) 2 for continuous casting of a titanium or titanium alloy ingot according to the present embodiment is installed in a continuous casting device (continuous casting device) 1 for a titanium or titanium alloy ingot. The continuous casting device 1, as shown in FIG. 1 as a perspective view and FIG. 2 as a sectional view, has the mold 2, a cold hearth (molten metal pouring device) 3, a raw material charging device 4, a plasma torch 5, a starting block (extractor) 6, and a plasma torch 7. The continuous casting device 1 is surrounded by an inert gas atmosphere comprising an argon gas, a helium gas, or the like.

The raw material charging device 4 charges the raw material of titanium or titanium ally such as sponge titanium or scrap into the cold hearth 3. The plasma torch 5 is installed above the cold hearth 3 and melts the raw material in the cold hearth 3 by generating a plasma arc. The cold hearth 3 pours molten metal 12 formed by melting the raw material into the mold 2 through a pouring section 3*a*. The mold 2 is made of copper, has no bottom, and is rectangular in cross-section. The mold 2 is configured so as to be cooled by water circulating at least in a part of the interior of a wall section constituting the four sides. The starting block 6 moves vertically by a drive section not shown in the figures and can block a lower side opening of the mold 2. The plasma torch 7 is installed above the mold 2 and heats the surface of the molten metal 12 poured into the mold 2 by a plasma arc.

In the above configuration, the molten metal 12 poured into the mold 2 solidifies from the face touching the mold 2 of a water-cooled type. Then the starting block 6 that has blocked the lower side opening of the mold 2 is pulled downward at a predetermined speed and thereby a slab 11 formed by solidifying the molten metal 12 is cast continuously while being extracted downward. Here, an ingot cast continuously is not limited to a slab 11.

Meanwhile, in electron beam melting in a vacuum atmosphere, the casting of titanium alloy is not easy because a fine component evaporates. In plasma arc melting in an inert gas atmosphere, however, it is possible to cast not only pure titanium but also titanium alloy. Meanwhile, to disperse flux on the surface of molten metal 12 with the aim of slowly cooling the molten metal 12 is a preferable embodiment but, in the electron beam melting in a vacuum atmosphere, it is not easy to charge flux into the molten metal 12 in the mold 2 because the flux scatters. In contrast, the plasma arc melting in an inert gas atmosphere is advantageous on the point that flux can be charged into the molten metal 12 in the mold 2.

(Generating Mechanism of Surface Defect)

Meanwhile, if unevenness or a flaw exists on the surface of a slab 11 (ingot skin) when the slab 11 of titanium or titanium alloy is cast continuously, the unevenness or the flaw comes to be a surface defect during a subsequent rolling process. For that reason, unevenness or a flaw on the surface of a slab 11 has to be removed by cutting or the like before rolling. This causes a lower yield, an increase of working processes, and thus a cost increase. For that reason, the casting of a slab 11 having no unevenness or flaw on the surface is desired.

Figure 3:
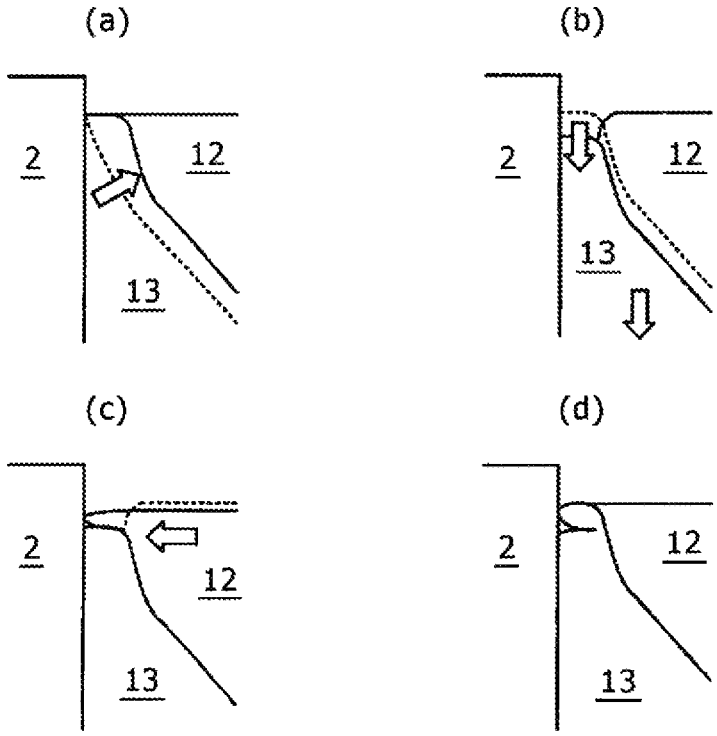
FIGS. 3(*a*) to 3(*d*) are explanatory views representing a generating mechanism of a surface defect.

Here, it is estimated that there exists, among defects generated on the surface of a slab 11, a defect generated by excessively growing a solidified shell in the vicinity of the wall surface of a mold 2, exposing the solidified shell on a molten metal surface, and thus generating molten metal covering. The mechanism is explained in reference to FIGS. 3(*a*) to 3(*d*). Firstly as shown in FIG. 3(*a*), a solidified shell 13 grows in the vicinity of the wall surface of a mold 2. Successively as shown in FIG. 3(*b*), the solidified shell 13 descends by extraction in the state of not supplying molten metal 12 to the vicinity of the wall surface of the mold 2. Then as shown in FIG. 3(*c*), the tip of the solidified shell 13 comes to be lower than the surface of the molten metal 12 and hence the molten metal 12 flows over the solidified shell 13. Then as shown in FIG. 3(*d*), the molten metal 12 having flown over the solidified shell 13 solidifies and comes to be the solidified shell 13. In this way, a surface defect is generated in a solidified shell 13 and comes to be a surface defect of a slab 11.

Figure 4:
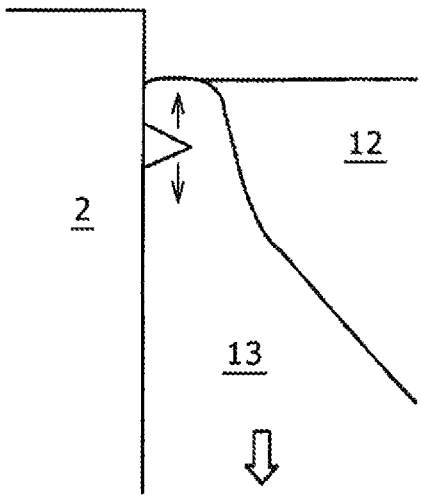
FIG. 4 is an explanatory view representing another generating mechanism of a surface defect.

Further, among defects generated on the surface of a slab 11, a defect generated by the breakage of a solidified shell 13 is estimated to exist. The mechanism is explained in reference to FIG. 4. A solidified shell 13 having grown in the vicinity of the wall surface of a mold 2 descends by extraction. On this occasion, the solidified shell 13 breaks by the frictional force acting at an interface between the grown solidified shell 13 and the mold 2 and the breakage comes to be a surface defect of a slab 11.

Figure 5:
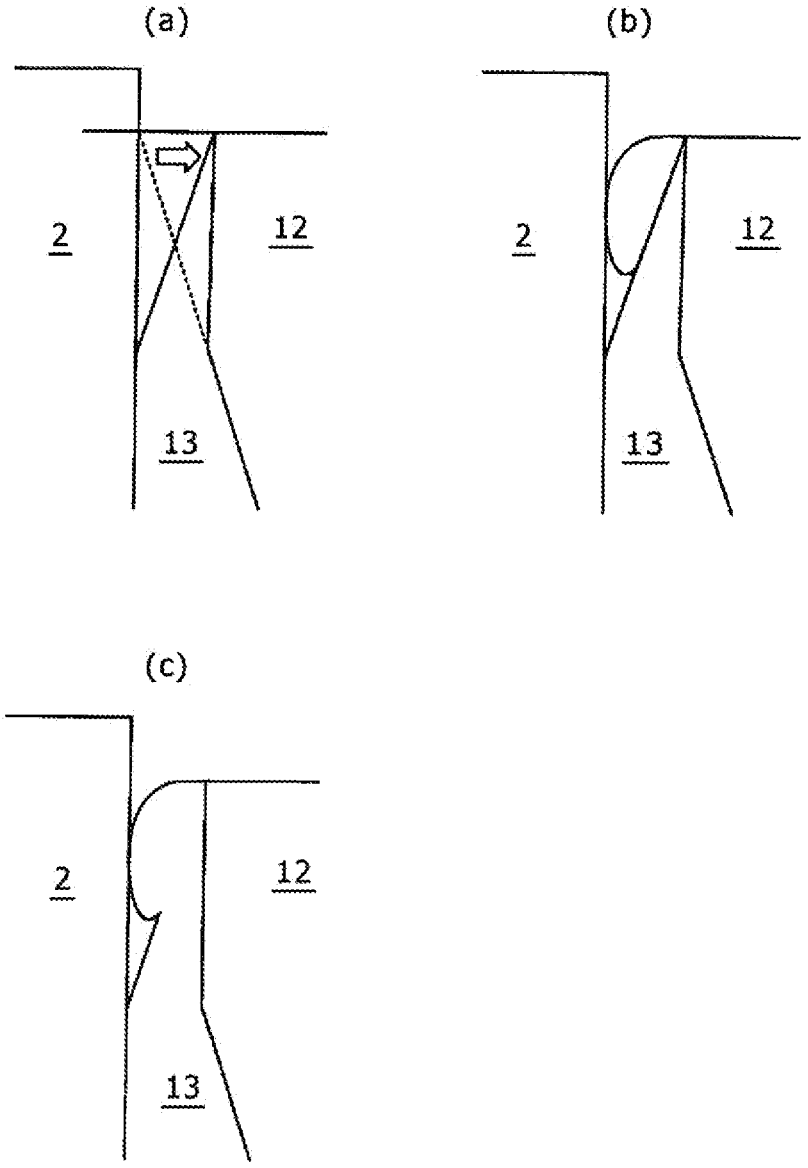
FIGS. 5(*a*) to 5(*c*) are explanatory views representing still another generating mechanism of a surface defect.

Furthermore, among defects generated on the surface of a slab 11, a defect generated by molten metal intrusion caused by the solidification and shrinkage of a solidified shell 13 is estimated to exist. The mechanism is explained in reference to FIGS. 5(*a*) to 5(*c*). Firstly as shown in FIG. 5(*a*), an excessively cooled solidified shell 13 solidifies and shrinks and thereby the solidified shell 13 deforms in the direction away from the wall surface of a mold 2. Successively as shown in FIG. 5(*b*), molten metal 12 flows into a gap formed between the mold 2 and the solidified shell 13. Then as shown in FIG. 5(*c*), the molten metal 12 having flown into the gap solidifies and comes to be the solidified shell 13. In this way, a surface defect is generated in a solidified shell 13 and comes to be a surface defect of a slab 11.

(Mold)

As stated above, a mold 2 is made of copper and is a water-cooled copper mold of a water-cooled type. Here, the material of the mold 2 is not limited to copper and a cooling fluid is not limited to water. The mold 2 is rectangular in cross-section and the length of the short side is L1 and the length of the long side is L2 as shown in the top view of FIG. 6. The mold 2 includes four corner sections 2*a* and four face sections 2*b*. Here, each of the face sections 2*b* is a section interposed between two corner sections 2*a* and the inner peripheral surfaces and the outer peripheral surfaces of the mold 2 at the face sections 2*b* are planes. Here, the inner peripheral surfaces and the outer peripheral surfaces of the mold 2 at the face sections 2*b* may somewhat be curved in consideration of thermal deformation.

Figure 6:
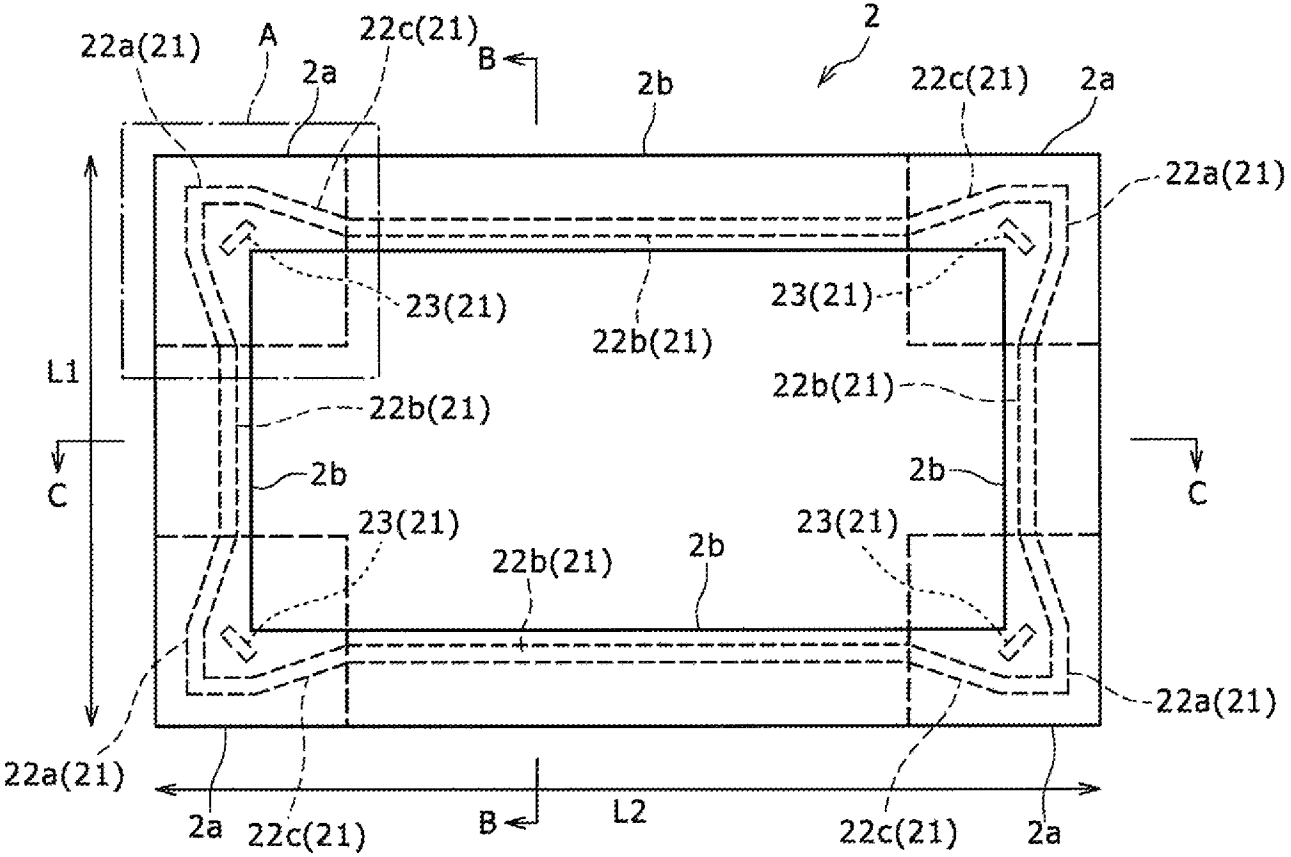
FIG. 6 is a top view showing the mold in FIG. 1.
Figure 7:
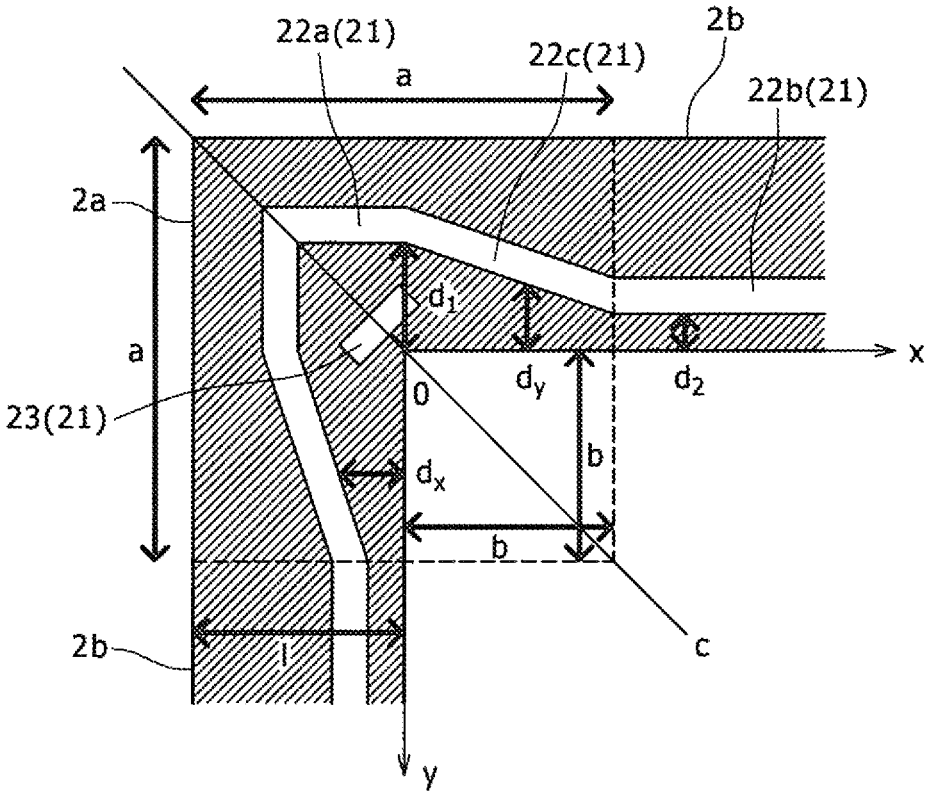
FIG. 7 is an enlarged sectional view of a substantial part A in FIG. 6.

As shown in FIG. 7 that is an enlarged sectional view of a substantial part A in FIG. 6, the length a of a corner section 2*a* along a short side and a long side in the horizontal direction is larger than the thickness I of a face section 2*b* and shorter than a half of the length L1 of the short side of the mold 2 (refer to FIG. 6). That is, the length a of a corner section 2*a* in the horizontal direction, the thickness I of a face section 2*b*, and the length L1 of the short side of a mold 2 satisfy the relationship represented by the expression $I<a<L1/2$.

Meanwhile, the length of a mold 2 in the vertical direction is 200 to 300 mm. In contrast, the length in the vertical direction of a mold used for continuously casting steel is not less than 600 mm. The reason is that it is unnecessary to increase a cooling range in the vertical direction since titanium or titanium alloy solidifies faster than steel.

Meanwhile, in continuous casting of steel, heat from molten steel concentrates at a corner section 2*a* where two sides touch each other and hence an arising problem is that the cooling rate of the molten steel touching the corner section 2*a* comes to be lower than the cooling rate of the molten steel touching a face section 2*b* and a solidification structure comes to be uneven. In continuous casting of steel therefore, it is necessary to equalize the surface temperature of a mold by enhancing the cooling capacity at a corner section 2*a*. In contrast, in continuous casting of titanium or titanium alloy like the present embodiment, unlike the case of steel, molten metal 12 is likely to be cooled more at a corner section 2*a* where two sides touch each other than at a face section 2*b* and hence the growth rate of a solidified shell 13 is larger at the corner section 2*a* than at the face section 2*b*. Consequently, by the mechanism explained in reference to FIGS. 3(*a*) to 3(*d*) and 5(*a*) to 5(*c*), a surface defect is likely to be generated more at a corner section 2*a*. For that reason, in continuous casting of titanium or titanium alloy, it is necessary to reduce a cooling capacity at a corner section 2*a* and reduce the cooling rate of molten metal 12 touching the corner section 2*a*. For that reason, as shown in FIG. 6, a mold 2 has a cooling means 21 for making a thermal flux at four corner sections 2*a* smaller than a thermal flux at four face sections 2*b*. Here, a thermal flux represents a heat quantity per unit area and unit time.

A cooling means 21, as shown in FIGS. 6 and 7, has first flow channels 22*a* through which cooling water flows, second flow channels 22*b* through which cooling water flows, and bypass flow channels 22*c* connecting the first flow channels 22*a* to the second flow channels 22*b*. The first flow channels 22*a* are embedded at four corner sections 2*a* of a mold 2 and installed extendedly in the horizontal direction respectively. The second flow channels 22*b* are embedded at four face sections 2*b* of the mold 2 and installed extendedly in the horizontal direction respectively. The bypass flow channels 22*c* are installed extendedly in the horizontal direction.

Figure 8:
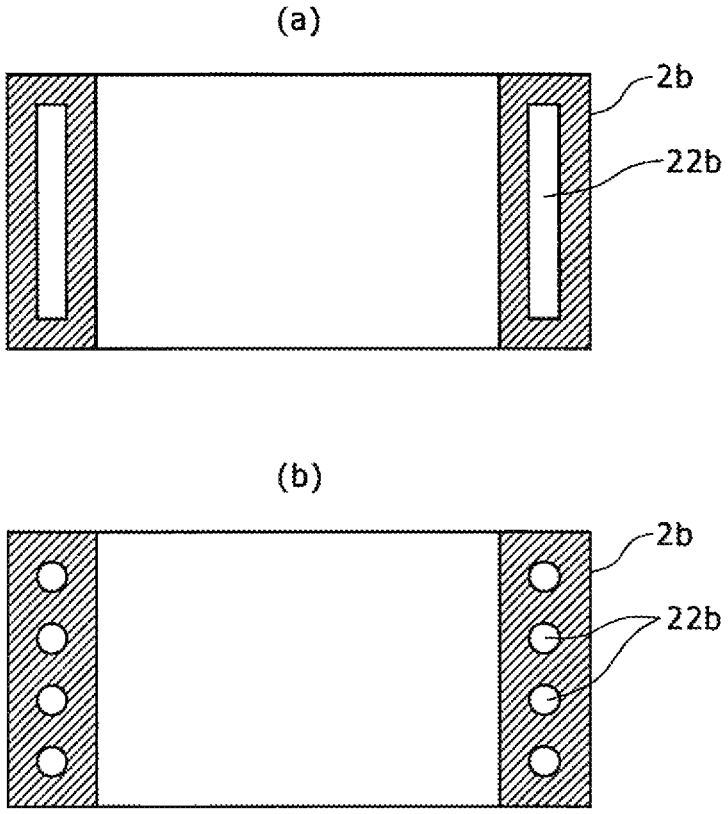
FIGS. 8(*a*) and 8(*b*) are examples of sectional views of the mold taken on line B-B in FIG. 6.
Figure 9:
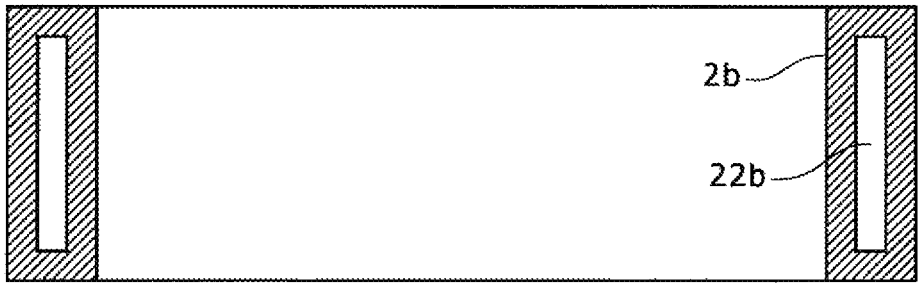
FIGS. 9(*a*) and 9(*b*) are examples of sectional views of the mold taken on line C-C in FIG. 6.
Figure 9:
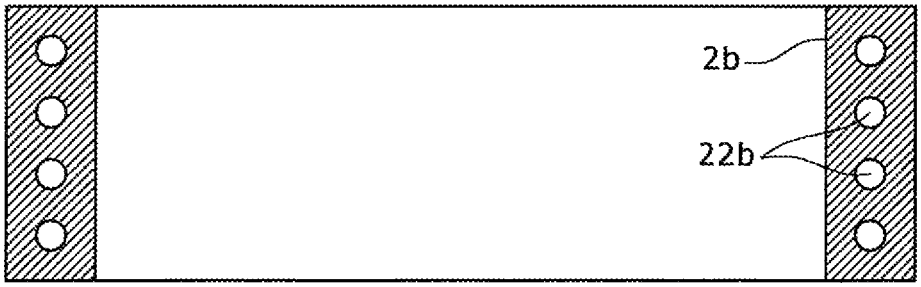

Second flow channels 22*b* may be formed in the range from an upper part to a lower part of a mold 2 as vertically-wide flow channels as shown in FIG. 8(*a*) that is a sectional view taken on line B-B in FIG. 6 and FIG. 9(*a*) that is a sectional view taken on line C-C in FIG. 6. Otherwise, second flow channels 22*b* may be formed so as to have plural paths at regular intervals in the range from an upper part to a lower part of a mold 2 as shown in FIG. 8(*b*) that is a sectional view taken on line B-B in FIG. 6 and FIG. 9(*b*) that is a sectional view taken on line C-C in FIG. 6. Here, the second flow channels 22*b* may preferably be formed partially at a level equal to the surface of molten metal 12. Then, when a mold 2 is manufactured by fitting an outer frame to the outer periphery of an inner frame on the outer peripheral surface of which grooves are formed, the second flow channels 22*b* may also be configured so that the grooves of the inner frame may be used as the second flow channels 22*b*. Further, when a mold 2 is manufactured by casting copper together with a material indissoluble in molten metal of copper, the second flow channels 22*b* may also be configured so that spaces formed by successively removing the material indissoluble in molten metal of copper may be used as the second flow channels 22*b*. The same is true for the first flow channels 22*a* and the bypass flow channels 22*c*. As stated above, the length of a mold 2 in the vertical direction is shorter than the length of a mold for continuously casting iron or steel. As a result, in the case of forming flow channels in the horizontal direction, the number of the flow channels and the number of pipes each of which connects the outlet of a flow channel to the inlet of another flow channel on the outer peripheral surface of a mold 2 can preferably be reduced further than the case of forming the flow channels in the vertical direction.

Here, as shown in FIG. 7, a distance d1 from the inner peripheral surface of a mold 2 to a first flow channel 22*a* is longer than a distance d2 from the inner peripheral surface of the mold 2 to a second flow channel 22*b*. As a result, a thermal flux at the four corner sections 2*a* of the mold 2 is smaller than a thermal flux at the four face sections 2*b* of the mold 2.

Concretely, a corner of a corner section 2*a* on the inner peripheral side is set as an original point, the long side direction is set at the x-axis direction, the short side direction is set at the y-axis direction, and the distances from the original point to the ends of the corner section 2*a* in the x-axis and y-axis directions are set at b. Further, the thermal conductivity of copper is represented by $\lambda_{Cu}$, a water temperature is represented by Tw, and a surface temperature of a slab 11 is represented by Ts. On this occasion, the thermal fluxes in the x-axis and y-axis directions at a face section 2*b* are expressed by the expressions $q_x=-\lambda_{Cu}(Tw-Ts)/d_2$ and $q_y\approx 0$ or by the expressions $q_x\approx 0$ and $q_y=-\lambda_{Cu}(Tw-Ts)/d_2$. In contrast, the thermal fluxes in the x-axis and y-axis directions at a corner section 2*a* are expressed by the expressions $q_x=-\lambda_{Cu}(Tw-Ts)/\alpha d_2$ and $q_y=-\lambda_{Cu}(Tw-Ts)/\alpha d_2$. Here, the expression $d_1=\alpha d_2$ ($\alpha>1$) holds. As a result, a thermal flux at the four corner sections 2*a* of the mold 2 is smaller than a thermal flux at the four face sections 2*b* of the mold 2.

Further, a distance $d_x$ from the inner peripheral surface of a mold 2 to a bypass flow channel 22*c* is represented by the expression $d_x=\alpha d_2-(\alpha-1)d_2y/b$ when the expression $0\le y\le b$ holds and by the expression $d_x=d_2$ when the expression $b<y$ holds. Furthermore, a distance $d_y$ from the inner peripheral surface of the mold 2 to a bypass flow channel 22*c* is represented by the expression $d_y=\alpha d_2-(\alpha-1)d_2x/b$ when the expression $0\le x\le b$ holds and by the expression $d_y=d_2$ when the expression $b<x$ holds. Consequently, the thermal flux in the x-axis direction is represented by the expression $q_x=-\lambda_{Cu}(Tw-Ts)/d_y$ and the thermal flux in the y-axis direction is represented by the expression $q_y=-\lambda_{Cu}(Tw-Ts)/d_x$.

Then by limiting the ranges of b and a allowing an extracted heat quantity to be equalized between a corner section 2*a* and a face section 2*b* by heat-transfer and solidification computation, it is possible to equalize the cooling rate of molten metal 12 at the corner section 2*a* and the cooling rate of the molten metal 12 at the face section 2*b*. As a result, it is possible to: equalize the shape of a solidified shell 13 in the mold 2; and hence inhibit the generation of molten metal covering, the breakage of the solidified shell 13, molten metal intrusion caused by solidification and shrinkage of the solidified shell 13, and others.

Further, a cooling means 21 has slow-cooling layers 23 embedded at the four corner sections 2*a* of a mold 2 respectively. The slow-cooling layers 23 are embedded on the side closer to the inner peripheral surface of the mold 2 than the first flow channels 22*a*. The slow-cooling layers 23 are air spaces and have smaller thermal conductivity than the mold 2 made of copper. As a result, a thermal flux at the four corner sections 2*a* of the mold 2 is smaller than a thermal flux at the four face sections 2*b* of the mold 2.

Concretely, the thermal conductivity of copper is represented by $\lambda_{Cu}$, the thermal conductivity of a slow-cooling layer 23 is represented by $\lambda'$, a water temperature is represented by Tw, and the surface temperature of a slab 11 is represented by Ts. Further, on a straight line c connecting the corner of a corner section 2*a* on the inner peripheral side to the corner of the corner section 2*a* on the outer peripheral side, the distance from the inner peripheral surface of the mold 2 to the slow-cooling layer 23 is represented by d5, the thickness of the slow-cooling layer 23 is represented by d4, and the distance from the slow-cooling layer 23 to a first flow channel 22*a* is represented by d3. On this occasion, the thermal flux when the slow-cooling layer 23 does not exist is represented by the expression $q=-\lambda_{Cu}(Tw-Ts)/(d_3+d_4+d_5)$. In contrast, the thermal flux when the slow-cooling layer 23 exists is represented by the expression $q'=-\lambda_{Cu}(Tw-Ts)/(d_3+\lambda_{Cu}d_4/\lambda'+d_5)$. Here, the expression $\lambda'<\lambda_{Cu}$ holds and thus the expression $q'<q$ holds. As a result, the thermal flux at the four corner sections 2*a* where the slow-cooling layers 23 exist is smaller than the thermal flux at the four face sections 2*b* where no slow-cooling layers 23 exist. Consequently, it is possible to equalize the cooling rate of molten metal 12 at the corner sections 2*a* and the cooling rate of the molten metal 12 at the face sections 2*b*.

Here, the slow-cooling layers 23 are not limited to the air spaces and may also be layers including a metal such as titanium (Ti), tungsten (W), tantalum (Ta), or molybdenum (Mo), each of those having smaller thermal conductivity than copper.

(Two-Dimensional Heat-Transfer and Solidification Analysis)

Figure 10:
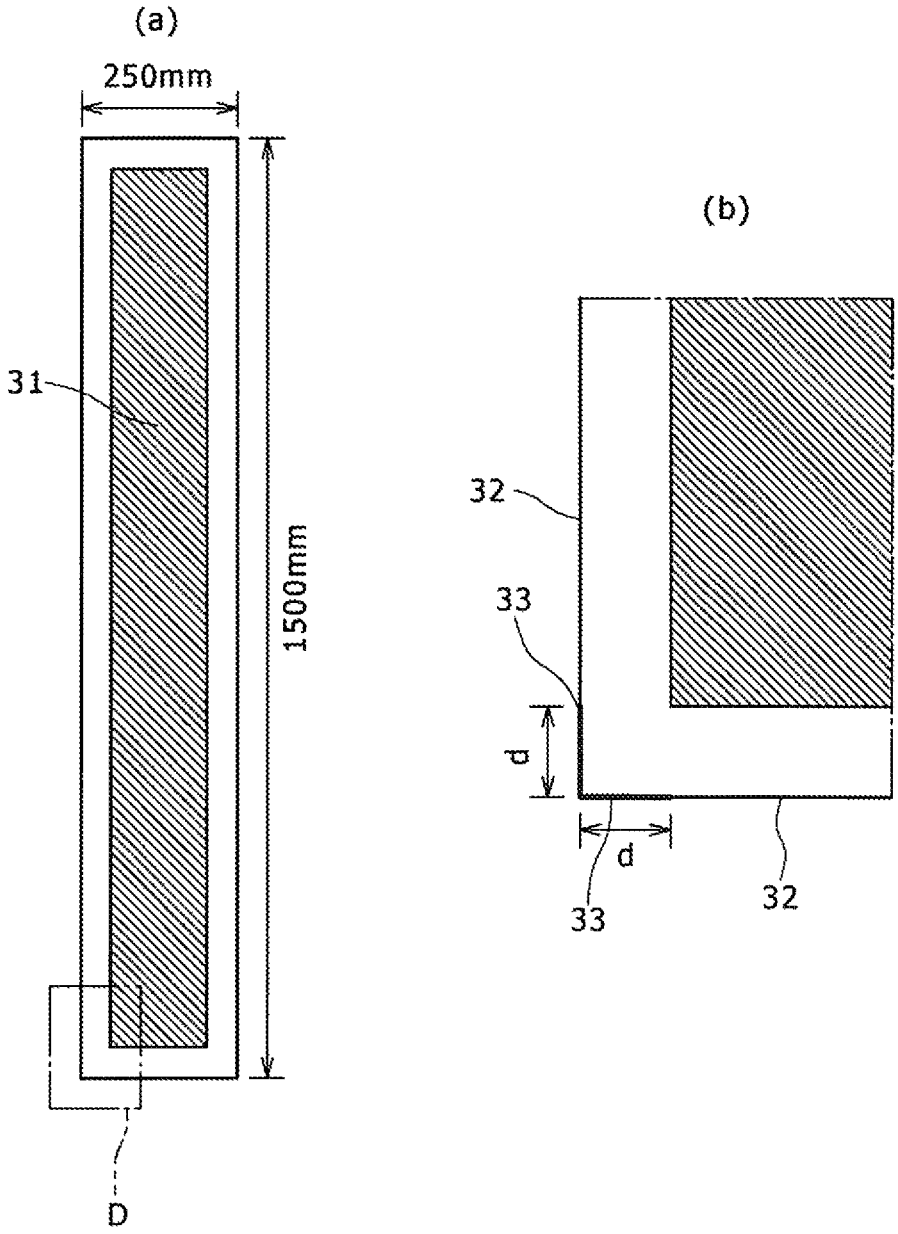
FIG. 10(*a*) is a top view showing a model of two-dimensional heat-transfer and solidification analysis and FIG. 10(*b*) is an enlarged view of a substantial part D in FIG. 10(*a*).
Figure 11:
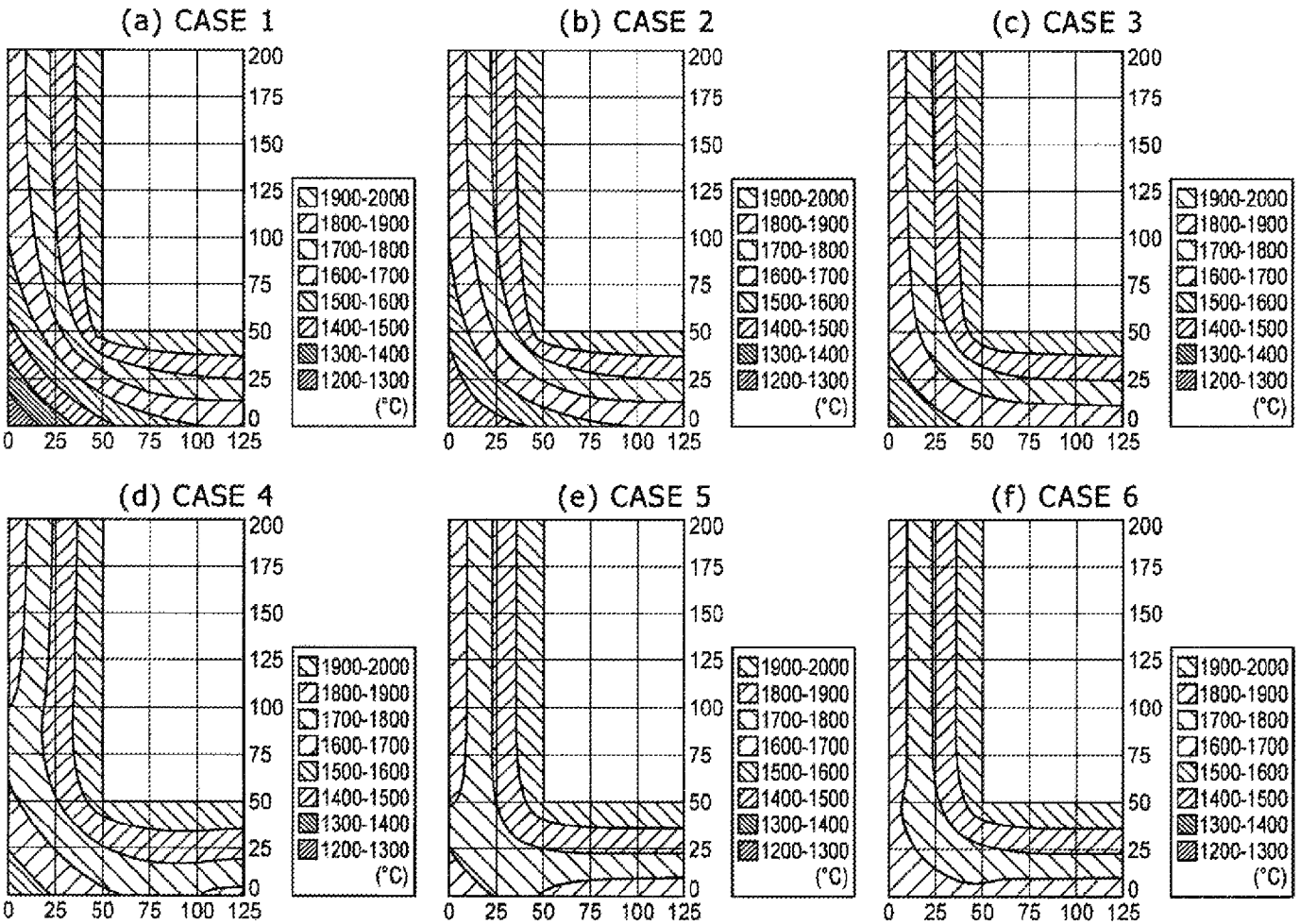
FIGS. 11(*a*) to 11(*f*) are views showing temperature distributions in the vicinities of corner sections.
Figure 12:
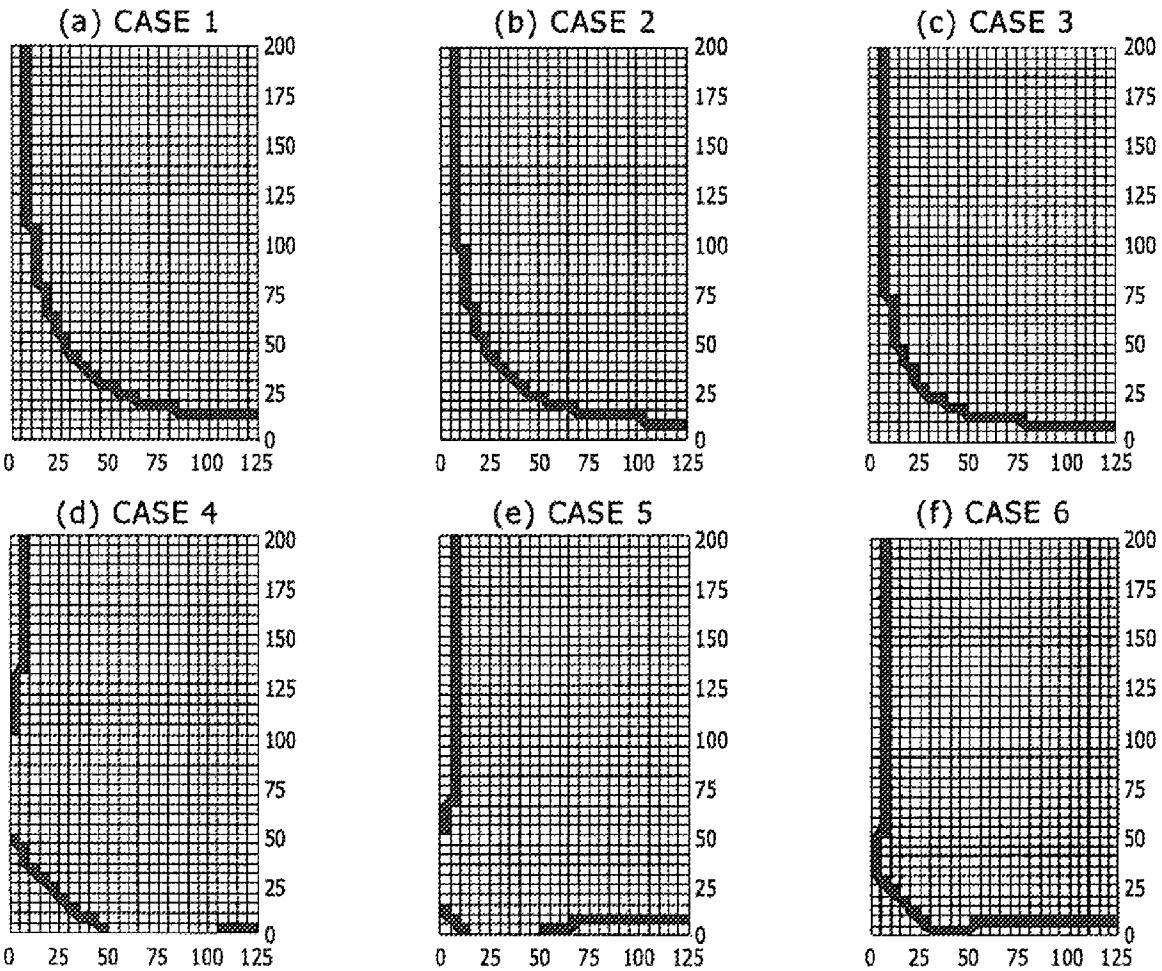
FIGS. 12(*a*) to 12(*f*) are views showing solidification interface distributions in the vicinities of corner sections.

Successively, two-dimensional heat-transfer and solidification analysis is carried out by using a model shown in FIGS. 10(*a*) and 10(*b*). As shown in FIG. 10(*a*) that is a top view, the length of the long side of a mold is 1,500 mm, the length of the short side thereof is 250 mm, and the temperature of a homogeneous heating region 31 is a constant temperature of 2,000° C. Further, as shown in FIG. 10(*b*) that is an enlarged view of a substantial part D in FIG. 10(*a*), the length of a corner section in the long side and short side directions is represented by d (mm). Further, a heat-transfer coefficient h is set at 1,500 $W/m^2/K$ and an external temperature is set at 200° C. as contact heat-transfer conditions on the outer peripheral surface 32 on the face section side and a heat-transfer coefficient h' is set at βh and an external temperature is set at 200° C. as contact heat-transfer conditions on the outer peripheral surface 33 on the corner section side. Here, the expression $\beta<1$ holds. Then with regard to the molds (Cases 1 to 6) different in the lengths d at the corner sections and the values β, the temperature distributions in the vicinities of the corner sections are investigated. Table 1 shows the lengths d at the corner sections and the values β in Cases 1 to 6. FIGS. 11(*a*) to 11(*f*) show the results. Further likewise, the solidification interface distributions in the vicinities of the corner sections are investigated. FIGS. 12(*a*) to 12(*f*) show the results.

TABLE 1

| Case | d [mm] | β |
|---|---|---|
| 1 | 0 | — |
| 2 | 25 | 0.5 |
| 3 | 50 | 0.5 |
| 4 | 100 | 0.5 |
| 5 | 50 | 0.2 |
| 6 | 50 | 0.3 |

As shown in FIGS. 11(*a*) to 11(*c*) and 12(*a*) to 12(*c*), in Cases 1 to 3, the cooling capacities at the corner sections are excessively high, the temperature gradients at the corner sections are excessively steep, and the solidified shells grow excessively at the corner sections. Inversely, as shown in FIGS. 11(*d*) and 11(*e*) and 12(*d*) and 12(*e*), in Cases 4 and 5, the cooling capacities at the corner sections are excessively low, the temperature gradients at the corner sections are excessively shelvy, and the solidified shells grow slowly at the corner sections. On that point, as shown in FIGS. 11(*f*) and 12(*f*), in Case 6, the temperature gradient at the corner section is shelvy and the growth of the solidified shell at the corner section is inhibited appropriately. In this way, by inhibiting the growth of a solidified shell at a corner section appropriately, it is possible to equalize the shape of the solidified shell in a mold.

(Effect)

As stated above, with a mold 2 and a continuous casting device 1 according to the present embodiment, a thermal flux at four corner sections 2*a* of the mold 2 is smaller than a thermal flux at four face sections 2*b* of the mold 2. As a result, it is possible to equalize the cooling rate of molten metal 12 at the corner sections 2*a* and the cooling rate of the molten metal 12 at the face sections 2*b*. As a result, it is possible: to equalize the shape of a solidified shell 13 in the mold 2; and hence to inhibit the generation of molten metal covering, the breakage of the solidified shell 13, molten metal intrusion caused by solidification and shrinkage of the solidified shell 13, and others. Consequently, it is possible to cast a slab 11 having fewer defects on the surface.

Further, molten metal 12 touching four corner sections 2*a* of a mold 2 is cooled by cooling water flowing through first flow channels 22*a* embedded at the corner sections 2*a* respectively. Furthermore, molten metal 12 touching four face sections 2*b* of the mold 2 is cooled by cooling water flowing through second flow channels 22*b* embedded at the face sections 2*b* respectively. On this occasion, since a distance from the inner peripheral surface of the mold 2 to the first flow channels 22*a* is longer than a distance from the inner peripheral surface of the mold 2 to the second flow channels 22*b*, a thermal flux at the four corner sections 2*a* of the mold 2 is smaller than a thermal flux at the four face sections 2*b* of the mold 2. As a result, it is possible to equalize the cooling rate of molten metal 12 at the corner sections 2*a* and the cooling rate of the molten metal 12 at the face sections 2*b*.

Further, by connecting first flow channels 22*a* to second flow channels 22*b*, those being installed extendedly in the horizontal direction, through bypass flow channels 22*c*, it is possible to make cooling water flow from the first flow channels 22*a* to the second flow channels 22*b*. Consequently, it is possible to: reduce the number of the outlets and inlets of the flow channels; and allow the cooling water to flow easily.

Further, a thermal flux at four corner sections 2*a* of a mold 2 is smaller than a thermal flux at four face sections 2*b* of the mold 2 by slow-cooling layers 23 embedded at the four corner sections 2*a* of the mold 2 respectively. As a result, it is possible to equalize the cooling rate of molten metal 12 at the corner sections 2*a* and the cooling rate of the molten metal 12 at the face sections 2*b*.

Modified Example

Meanwhile, as a first modified example of a mold 2 according to the first embodiment, a cooling means 21 constituting the mold 2 may have only first flow channels 22*a*, second flow channels 22*b*, and bypass flow channels 22*c*. That is, the cooling means 21 may not have slow-cooling layers 23. By such a configuration too, it is possible to make a thermal flux at four corner sections 2*a* of a mold 2 smaller than a thermal flux at four face sections 2*b* of the mold 2.

Further, as a second modified example of a mold 2 according to the first embodiment, a cooling means 21 constituting the mold 2 may have only slow-cooling layers 23. That is, the cooling means 21 may not have first flow channels 22*a*, second flow channels 22*b*, and bypass flow channels 22*c*. By such a configuration too, it is possible to make a thermal flux at four corner sections 2*a* of a mold 2 smaller than a thermal flux at four face sections 2*b* of the mold 2.

Second Embodiment

Mold

Figure 13:
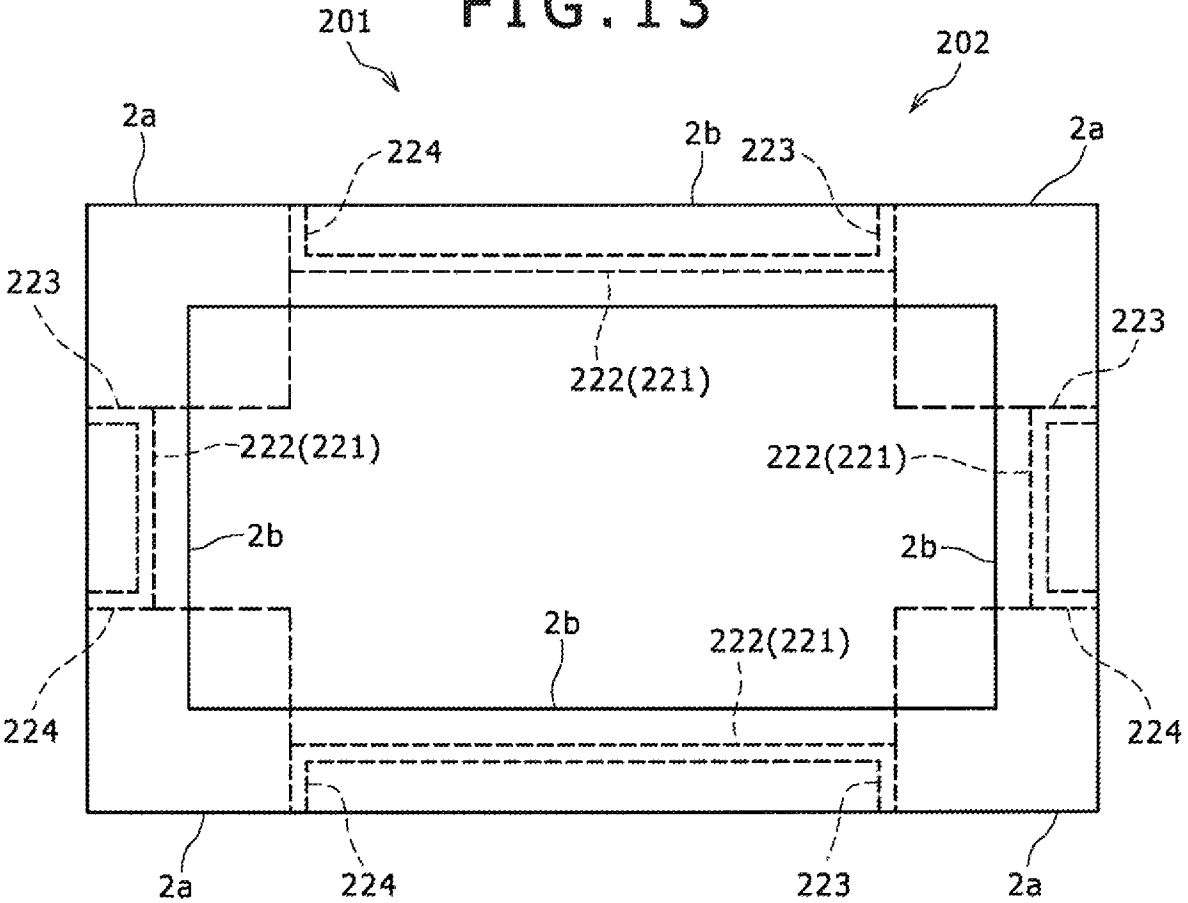
FIG. 13 is a top view showing a mold according to the second embodiment.

A continuous casting device 201 according to the second embodiment of the present invention is explained hereunder. Here, a constituent component identical to an aforementioned constituent component is represented by an identical reference numeral and the explanations are omitted. The different point of the continuous casting device 201 according to the present embodiment from a continuous casting device 1 according to the first embodiment is that, as shown in FIG. 13 that is a top view, a mold 202 has a cooling means 221 that makes a thermal flux at four corner sections 2*a* smaller than a thermal flux at four face sections 2*b*.

The cooling means 221 has flow channels 222 through which cooling water flows. The flow channels 222 are embedded at the four face sections 2*b* of the mold 202 and installed extendedly in the horizontal direction respectively. Inlet passages 223 to introduce cooling water into the flow channels 222 and outlet passages 224 to exhaust the cooling water from the flow channels 222 are connected to the flow channels 222 respectively.

In this way, the cooling means 221 has no flow channels at the four corner sections 2*a*. As a result, a thermal flux at the four corner sections 2*a* of the mold 202 is smaller than a thermal flux at the four face sections 2*b* of the mold 202. As a result, it is possible to equalize the cooling rate of molten metal 12 at the corner sections 2*a* and the cooling rate of the molten metal 12 at the face sections 2*b*.

Here, the cooling means 221 may have slow-cooling layers 23 embedded at the four corner sections 2*a* respectively in the same manner as the first embodiment.

(Effect)

As stated above, with a mold 202 and a continuous casting device 201 according to the present embodiment, molten metal 12 touching four face sections 2*b* of the mold 202 is cooled by cooling water flowing through flow channels 222 embedded at the face sections 2*b* respectively. On the other hand, since no flow channels are installed at four corner sections 2*a* of the mold 202, a thermal flux at the four corner sections 2*a* of the mold 202 is smaller than a thermal flux at the four face sections 2*b* of the mold 202. As a result, it is possible to equalize the cooling rate of the molten metal 12 at the corner sections 2*a* and the cooling rate of the molten metal 12 at the face sections 2*b*.

Third Embodiment

Mold

Figure 14:
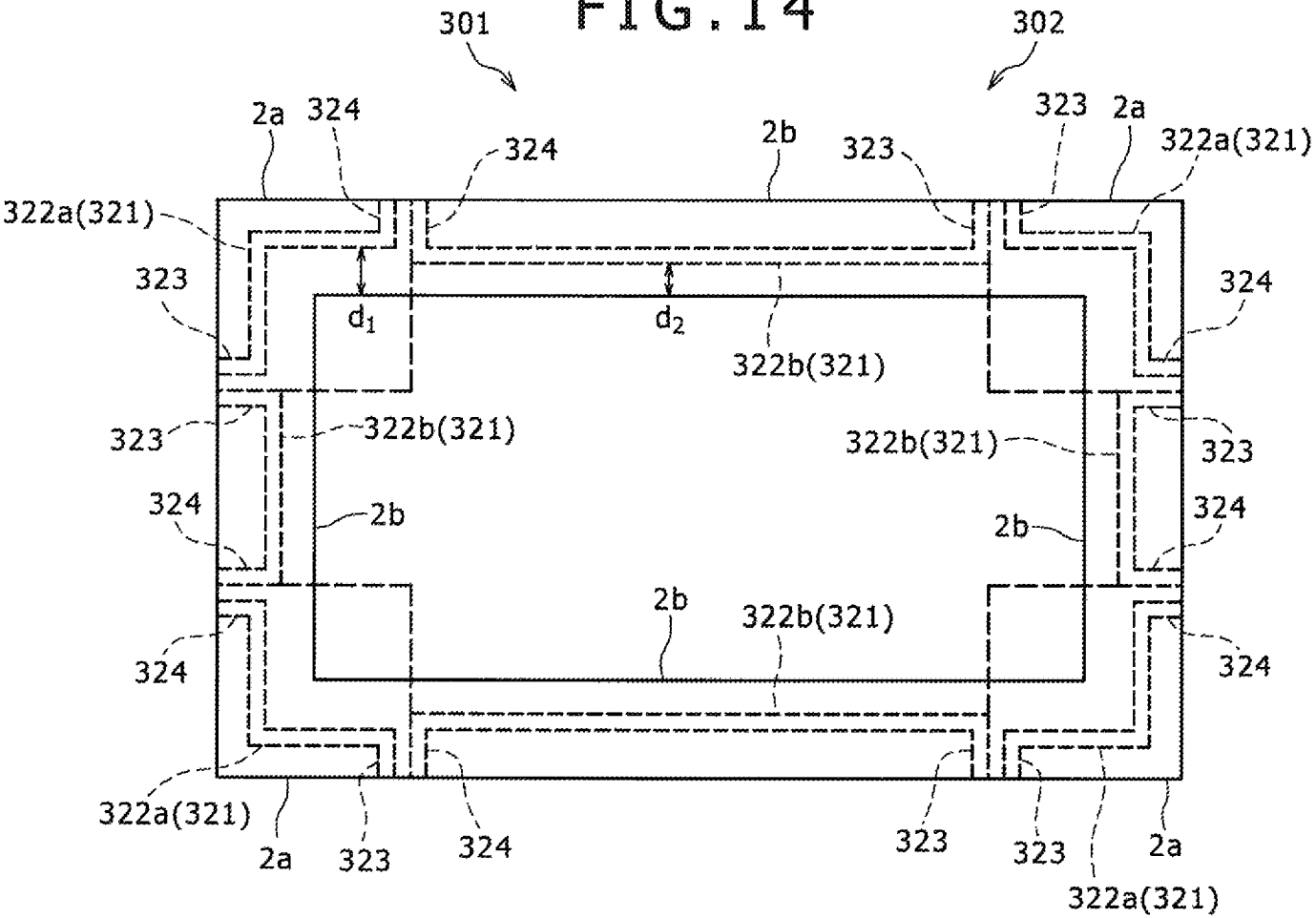
FIG. 14 is a top view showing a mold according to the third embodiment.

A continuous casting device 301 according to the third embodiment of the present invention is explained hereunder. Here, a constituent component identical to an aforementioned constituent component is represented by an identical reference numeral and the explanations are omitted. The different point of the continuous casting device 301 according to the present embodiment from a continuous casting device 1 according to the first embodiment is that, as shown in FIG. 14 that is a top view, a mold 302 has a cooling means 321 that makes a thermal flux at four corner sections 2*a* smaller than a thermal flux at four face sections 2*b*.

The cooling means 321 has first flow channels 322*a* through which cooling water flows and second flow channels 322*b* through which the cooling water flows. The first flow channels 322*a* are embedded at the four corner sections 2*a* of the mold 302 and installed extendedly in the horizontal direction respectively. The second flow channels 322*b* are embedded at the four face sections 2*b* of the mold 302 and installed extendedly in the horizontal direction respectively. Inlet passages 323 to introduce the cooling water into the flow channels 322*a* and 322*b* are connected to the flow channels 322*a* and 322*b*. Further, outlet passages 324 to exhaust the cooling water from the flow channels 322*a* and 322*b* are connected to the flow channels 322*a* and 322*b*. The first flow channels 322*a* do not communicate with the second flow channels 322*b*.

Here, a distance d1 from the inner peripheral surface of the mold 302 to a first flow channel 322*a* is longer than a distance d2 from the inner peripheral surface of the mold 302 to a second flow channel 322*b*. As a result, a thermal flux at the four corner sections 2*a* of the mold 302 is smaller than a thermal flux at the four face sections 2*b* of the mold 302. As a result, it is possible to equalize the cooling rate of molten metal 12 at the corner sections 2*a* and the cooling rate of the molten metal 12 at the face sections 2*b*.

Further, a flow rate of cooling water flowing through the first flow channels 322*a* is set to be lower than a flow rate of the cooling water flowing through the second flow channels 322*b*. As a result, it is possible to appropriately reduce a thermal flux at the four corner sections 2*a* so as to be smaller than a thermal flux at the four face sections 2*b*. Here, in the case where the cross-sectional shape of the flow channels is round, if a flow rate of cooling water is represented by u, a flow quantity is represented by Q, a flow channel cross-sectional area is represented by E, and a diameter of the flow channels is represented by e, the relationship represented by the expressions $u=Q/E$ and $E=\pi e^2/4$ is satisfied. Consequently, when a flow quantity Q of cooling water is constant in the first flow channels 322*a* and the second flow channels 322*b*, it is possible to control the flow rate u of the cooling water by adjusting the flow channel diameter e at the corner sections 2*a* and the face sections 2*b*. Otherwise, when the flow channel diameter e is identical at the first flow channels 322*a* and the second flow channels 322*b*, it is possible to control the flow rate u of the cooling water by adjusting the flow quantity Q at the corner sections 2*a* and the face sections 2*b*. Further, a temperature of the cooling water flowing through the first flow channels 322*a* may be set to be higher than a temperature of the cooling water flowing through the second flow channels 322*b*.

Here, the cooling means 321 may have slow-cooling layers 23 embedded at the four corner sections 2*a* respectively in the same manner as the first embodiment.

Modified Examples of Present Embodiments

Although the embodiments according to the present invention have been explained heretofore, the embodiments are merely concrete examples and do not particularly limit the present invention. Concrete configurations can be redesigned or modified arbitrarily. Further, the functions and effects described in the embodiments according to the present invention are only the most appropriate functions and effects derived from the present invention and the functions and effects according to the present invention are not limited to the functions and effects described in the embodiments according to the present invention.

For example, a configuration of heating the surface of molten metal 12 by a plasma arc generated from a plasma torch 7 is appropriate but the present invention is not limited to the configuration. A configuration of heating the surface of molten metal 12 by an electron beam, a non-consumable electrode type arc, or high-frequency induction heating may be adopted.

Further, although first flow channels 22*a*, second flow channels 22*b*, and bypass flow channels 22*c* according to the first embodiment, flow channels 222 according to the second embodiment, and first flow channels 322*a* and second flow channels 322*b* according to the third embodiment are all installed extendedly in the horizontal direction, they may be installed extendedly in the vertical direction.

The present application is based on Japanese Patent Application No. 2012-083683 filed on Apr. 2, 2012 and the contents are incorporated herein by reference in its entirety.

LIST OF REFERENCE SIGNS

1, 201, 301 Continuous casting device
2, 202, 302 Mold
2*a* Corner section
2*b* Face section
3 Cold hearth (molten metal pouring device)
3*a* Pouring section
4 Raw material charging device
5 Plasma torch
6 Starting block (extractor)
7 Plasma torch
11 Slab
12 Molten metal
13 Solidified shell
21, 221, 321 Cooling means
22*a*, 322*a* First flow channel
22*b*, 322*b* Second flow channel
22*c* Bypass flow channel
23 Slow-cooling layer
31 Homogeneous heating region
32 Outer peripheral surface on the face section side
33 Outer peripheral surface on the corner section side
222 Flow channel
223, 323 Inlet passage
224, 324 Outlet passage

The invention claimed is:

1. A mold for continuous casting of a titanium or titanium alloy ingot, the mold being used for continuously casting the titanium or titanium alloy ingot and being rectangular in cross-section but not having a bottom section, into which molten metal of titanium or titanium alloy is poured, wherein the mold comprises:

a first flow channel for a cooling fluid embedded at a corner section of the mold, and a second flow channel for the cooling fluid embedded at a face section of the mold, wherein a distance from an inner peripheral surface of the mold to the first flow channel is larger than a distance from the inner peripheral surface of the mold to the second flow channel when measure in the same direction, and wherein the first and second flow channels wrap completely around a periphery of the mold in a plan view.

2. The mold for continuous casting of a titanium or titanium alloy ingot according to claim 1, further comprising slow-cooling layers embedded at the four corner sections of the mold respectively and having smaller thermal conductivity than the mold.

3. The mold for continuous casting of a titanium or titanium alloy ingot according to claim 1, wherein the mold further comprises a slow-cooling layer embedded at the corner section of the mold on a side closer to the inner peripheral surface of the mold than the first flow channel and having smaller thermal conductivity than the mold.

4. A continuous casting device for a titanium or titanium alloy ingot comprising:

the mold according to claim 1;

a molten metal pouring device to pour molten metal into the mold; and an extractor to extract an ingot formed by solidifying the molten metal in the mold below the mold.

5. A mold for continuous casting of a titanium or titanium alloy ingot, the mold being used for continuously casting the titanium or titanium alloy ingot and being rectangular in cross-section but not having a bottom section, into which molten metal of titanium or titanium alloy is poured, wherein the mold has a cooling means for making a thermal flux at four corner sections of the mold smaller than a thermal flux at four face sections interposed between the corner sections, and wherein the cooling means has slow-cooling layers embedded at the four corner sections of the mold respectively and having smaller thermal conductivity than the mold.

6. The mold for continuous casting of a titanium or titanium alloy ingot according to claim 5, wherein the cooling means has flow channels embedded at the four face sections of the mold respectively, through which a cooling fluid flows.

7. The mold for continuous casting of a titanium or titanium alloy ingot according to claim 5, wherein the cooling means has:

first flow channels embedded at the four corner sections of the mold respectively, through which a cooling fluid flows, and second flow channels embedded at the four face sections of the mold respectively, through which the cooling fluid flows; and a distance from an inner peripheral surface of the mold to the first flow channels is larger than a distance from the inner peripheral surface of the mold to the second flow channels.

8. The mold for continuous casting of a titanium or titanium alloy ingot according to claim 7, wherein the first flow channels and the second flow channels are installed extendedly in a horizontal direction; and the cooling means further has bypass flow channels connecting the first flow channels to the second flow channels.

9. The mold for continuous casting of a titanium or titanium alloy ingot according to claim 7, wherein the cooling means further has slow-cooling layers embedded at the four corner sections of the mold on a side closer to the inner peripheral surface of the mold than the first flow channels respectively and having smaller thermal conductivity than the mold.

10. A continuous casting device for a titanium or titanium alloy ingot comprising:

the mold according to claim 5;

a molten metal pouring device to pour molten metal into the mold; and an extractor to extract an ingot formed by solidifying the molten metal in the mold below the mold.

11. The mold for continuous casting of a titanium or titanium alloy ingot according to claim 8, wherein the cooling means further has slow-cooling layers embedded at the four corner sections of the mold on a side closer to the inner peripheral surface of the mold than the first flow channels respectively and having smaller thermal conductivity than the mold.

* * * * *